US005474050A

United States Patent [19]

Cook et al.

[11] Patent Number: 5,474,050

[45] Date of Patent: Dec. 12, 1995

[54] LEAK DETECTION PUMP WITH INTEGRAL VENT SEAL

[75] Inventors: John E. Cook; Murray F. Busato; Paul D. Perry, all of Chatham, Canada

[73] Assignee: Siemens Electric Limited, Chatham, Canada

[21] Appl. No.: 372,264

[22] Filed: Jan. 13, 1995

[51] Int. Cl.[6] ..... F02M 37/04

[52] U.S. Cl. ..... 123/520; 123/198 D

[58] Field of Search ..... 123/520, 519, 123/518, 516, 521, 198 D; 417/34, 35, 46, 28, 395

[56] References Cited

U.S. PATENT DOCUMENTS

| | | | |
|---|---|---|---|
| 3,176,459 | 4/1965 | Parker | 417/34 |
| 4,551,076 | 11/1985 | Dubois | 417/395 |
| 4,846,119 | 7/1989 | Geuer | 417/395 |
| 5,193,512 | 3/1993 | Steinbrenner | 123/198 D |
| 5,230,319 | 7/1993 | Otsuka | 123/198 D |
| 5,246,351 | 9/1993 | Horn | 417/395 |
| 5,297,529 | 3/1994 | Cook | 123/520 |
| 5,383,437 | 1/1995 | Cook | 123/520 |
| 5,411,004 | 5/1995 | Bosato | 123/520 |

*Primary Examiner*—Carl S. Miller

[57] ABSTRACT

An on-board diagnostic system for an evaporative emission control system of an internal combustion engine powered vehicle employs a positive displacement reciprocating pump to create in evaporative emission space a pressure that differs significantly from ambient atmospheric pressure. The pump is powered by using engine intake manifold vacuum to force an intake stroke during which both an internal spring is increasingly compressed and a charge of ambient atmospheric air is created in an air pumping chamber space. Vacuum is then removed, and the spring relaxes to force a compression stroke wherein a portion of the air charge is forced into the evaporative emission space. The rate at which the pump reciprocates to alternately execute intake and compression strokes indicates the pressure and flow through a leak in the evaporative emission space. Detection of this rate serves as a measurement of leakage for the purpose of distinguishing integrity of the evaporative emission space from non-integrity. The disclosed pump has a novel arrangement of its internal valving that reduces the number of parts required in comparison to a previous pump.

18 Claims, 2 Drawing Sheets

LEAK DETECTION PUMP WITH INTEGRAL VENT SEAL

FIELD OF THE INVENTION

This invention relates to evaporative emission control systems for the fuel systems of internal combustion engine powered automotive vehicles, particularly to apparatus for confirming the integrity of an evaporative emission control system against leakage.

BACKGROUND

A typical evaporative emission control system in a modern automotive vehicle comprises a vapor collection canister that collects volatile fuel vapors generated in the headspace of the fuel tank by the volatilization of liquid fuel in the tank. During conditions conducive to purging, the evaporative emission space which is cooperatively defined by the tank headspace and the canister is purged to the engine intake manifold by means of a canister purge system that comprises a canister purge solenoid valve connected between the canister and the engine intake manifold and operated by an engine management computer. The canister purge solenoid valve is opened by a signal from the engine management computer in an amount that allows the intake manifold vacuum to draw volatile vapors from the canister for entrainment with the combustible mixture passing into the engine's combustion chamber space at a rate consistent with engine operation to provide both acceptable vehicle driveability and an acceptable level of exhaust emissions.

U.S. governmental regulations require that certain future automotive vehicles powered by internal combustion engines which operate on volatile fuels such as gasoline have their evaporative emission control systems equipped with on-board diagnostic capability for determining if a leak is present in the evaporative emission space. It has heretofore been proposed to make such a determination by temporarily creating a pressure condition in the evaporative emission space which is substantially different from the ambient atmospheric pressure, and then watching for a change in that substantially different pressure which is indicative of a leak.

Commonly owned U.S. Pat. No. 5,146,902 "Positive Pressure Canister Purge System Integrity Confirmation" discloses a system and method for making such a determination by pressurizing the evaporative emission space by creating a certain positive pressure therein (relative to ambient atmospheric pressure) and then watching for a drop in that pressure indicative of a leak. Leak integrity confirmation by positive pressurization of the evaporative emission space offers certain benefits over leak integrity confirmation by negative pressurization, as mentioned in the referenced patent.

Pending, allowed, commonly owned application Ser. No. 07/995,484 filed 23 Dec. 1992 discloses an arrangement and technique for measuring the effective orifice size of relatively small leakage from the evaporative emission space once the pressure has been brought substantially to a predetermined magnitude that is substantially different from ambient atmospheric pressure. Generally speaking, this involves the use of a reciprocating pump to create such pressure magnitude in the evaporative emission space and a switch that is responsive to reciprocation of the pump mechanism. More specifically, the pump comprises a movable wall that is reciprocated over a cycle which comprises an intake stroke and a compression stroke to create such pressure magnitude in the evaporative emission space. On an intake stroke, a charge of atmospheric air is drawn in an air pumping chamber space of the pump. On an ensuing compression stroke, the movable wall is urged by a mechanical spring to compress a charge of air so that a portion of the compressed air charge is forced into the evaporative emission space. On a following intake stroke, another charge of atmospheric air is created.

At the beginning of the integrity confirmation procedure, the pump reciprocates rapidly, seeking to build pressure toward a predetermined level. If a gross leak is present, the pump will be incapable of pressurizing the evaporative emission space to the predetermined level, and hence will keep reciprocating rapidly. Accordingly, continuing rapid reciprocation of the pump beyond a time by which the predetermined pressure should have been substantially reached will indicate the presence of a gross leak, and the evaporative emission control system may therefore be deemed to lack integrity.

The pressure which the pump strives to achieve is set essentially by its aforementioned mechanical spring. In the absence of a gross leak, the pressure will build toward the predetermined level, and the rate of reciprocation will correspondingly diminish. For a theoretical condition of zero leakage, the reciprocation will cease at a point where the spring is incapable of forcing any more air into the evaporative emission space.

Leaks smaller than a gross leak are detected in a manner that is capable of giving a measurement of the effective orifice size of leakage, and consequently the arrangement is capable of distinguishing between very small leakage which may be deemed acceptable and somewhat larger leakage which, although considered less than a gross leak, may nevertheless be deemed unacceptable. The ability to provide some measurement of the effective orifice size of leakage that is smaller than a gross leak, rather than just distinguishing between integrity and non-integrity, may be considered important for certain automotive vehicles, and in this regard the arrangement is especially advantageous since the means by which the measurement is obtained is accomplished by an integral component of the pump, rather than by a separate pressure sensor.

The means for obtaining the measurement comprises a switch which, as an integral component of the pump, is disposed to sense reciprocation of the pump mechanism. Such a switch may be a reed switch, an optical switch, or a Hall sensor, for example. The switch is used both to cause the pump mechanism to reciprocate at the end of a compression stroke and as an indication of how fast air is being pumped into the evaporative emission space. Since the rate of pump reciprocation will begin to decrease as the pressure begins to build, detection of the rate of switch operation can be used in the first instance to determine whether or not a gross leak is present. As explained above, a gross leak is indicated by failure of the rate of switch operation to fall below a certain frequency within a certain amount of time. In the absence of a gross leak, the frequency of switch operation provides a measurement of leakage that can be used to distinguish between integrity and non-integrity of the evaporative emission space even though the leakage has already been determined to be less than a gross leak. Once the evaporative emission space pressure has built substantially to the predetermined pressure, the switch's indication of a pump reciprocation rate at less than a certain frequency will indicate integrity of the evaporative emission space while indication of a greater frequency will indicate non-integrity.

The pump is also used to perform flow confirmation that would confirm the absence of blockage in the purge flow conduits.

SUMMARY OF THE INVENTION

The present invention relates to further improvements in the organization and arrangement of the pump.

The invention retains advantages of the earlier pump: by enabling integrity confirmation to be made while the engine is running; by enabling integrity confirmation to be made over a wide range of fuel tank fills between full and empty so that the procedure is for the most part independent of tank size and fill level; by providing a procedure that is largely independent of the particular type of volatile fuel being used; and by providing a reliable, cost-effective means for compliance with on-board diagnostic requirements for assuring leakage integrity of an evaporative emission control system.

Additionally, the invention provides the pump with novel internal valving for selectively communicating the air pumping chamber space, a first port leading to the evaporative emission space, and a second port leading to atmosphere. This novel arrangement employs fewer parts, and consequently offers opportunity for improved manufacturing economy and in-use reliability The foregoing, along with additional features, advantages, and benefits of the invention, will be seen in the ensuing description and claims which should be considered in conjunction with the accompanying drawings. The drawings disclose a presently preferred embodiment of the invention according to the best mode contemplated at this time for carrying out the invention.

DESCRIPTION OF THE PREFERRED EMBODIMENT

Figures 1, 3:
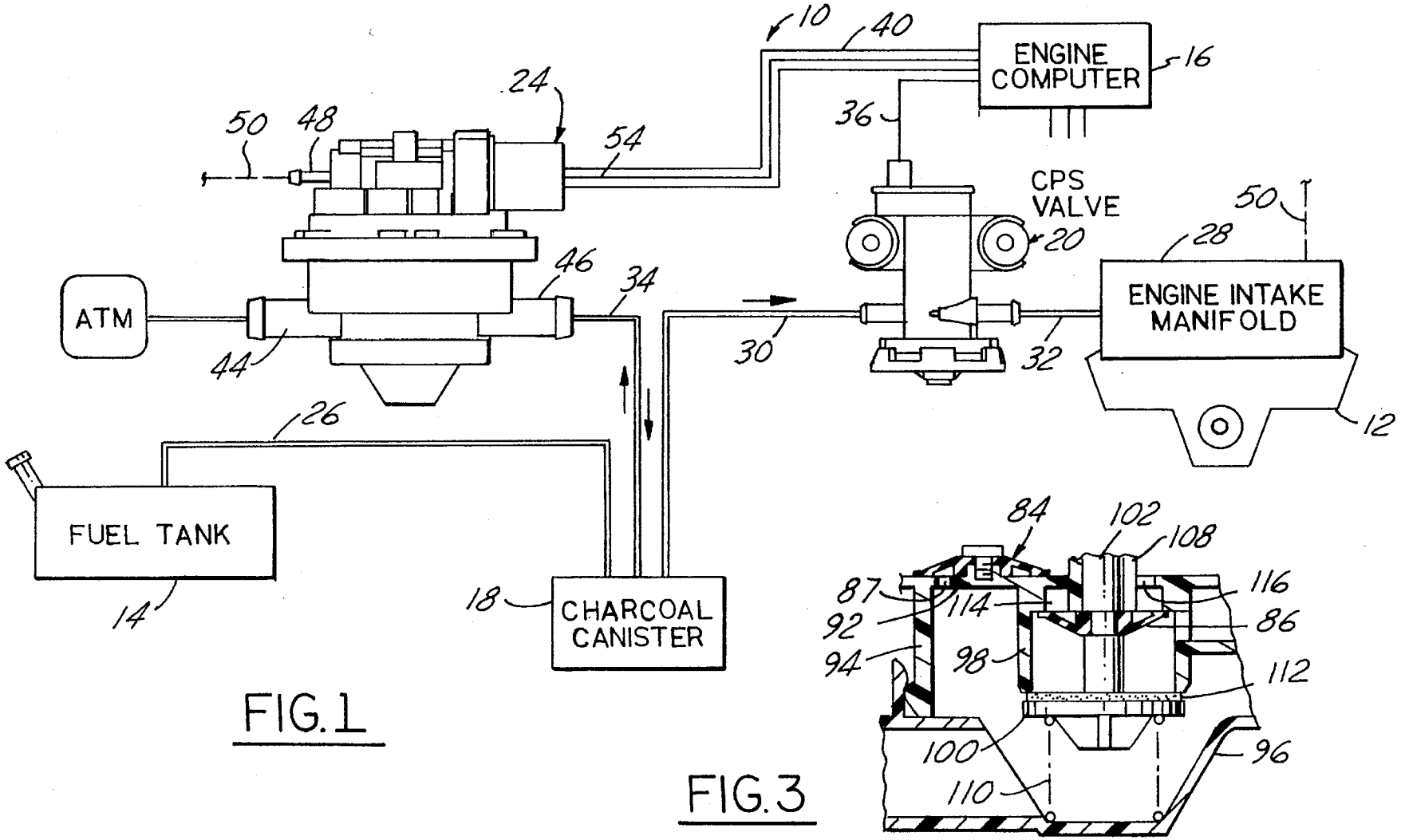
FIG. 1 is a general schematic diagram of an evaporative emission control system embodying principles of the present invention, including relevant portions of an automobile.
FIG. 3 is a fragmentary view of a portion of FIG. 3 showing an operative position different from that of FIG. 2.

FIG. 1 shows an evaporative emission control (EEC) system 10 for an internal combustion engine powered automotive vehicle comprising in association with the vehicle's engine 12, fuel tank 14, and engine management computer 16, a conventional vapor collection canister (charcoal canister) 18, a canister purge solenoid (CPS) valve 20, and a leak detection pump (LDP) 24.

The headspace of fuel tank 14 is placed in fluid communication with an inlet port of canister 18 by means of a conduit 26 so that they cooperatively define an evaporative emission space within which fuel vapors generated from the volatilization of fuel in the tank are temporarily confined and collected until purged to an intake manifold 28 of engine 12. A second conduit 30 fluid-connects an outlet port of canister 18 with an inlet port of CPS valve 20, while a third conduit 32 fluid-connects an outlet port of CPS valve 20 with intake manifold 28. A fourth conduit 34 fluid-connects a vent port of canister 18 with a first port 46 of LDP 24. LDP 24 also has a second port 44 that communicates directly with atmosphere.

Engine management computer 16 receives a number of inputs (engine parameters) relevant to control of the engine and its associated systems, including EEC system 10. One electrical output port of the computer controls CPS valve 20 via an electrical connection 36, and another, leak detection pump 24 via an electrical connection 40.

LDP 24 has a vacuum inlet port 48 that is communicated by a conduit 50 with intake manifold 28, and an electrical outlet at which it provides a signal to computer 16 via an electrical connection 54.

While the engine is running, operation of LDP 24 is commanded from time to time by computer 16 as part of an occasional diagnostic procedure for confirming the integrity of EEC system 10 against leakage. During occurrences of such diagnostic procedure, computer 16 commands CPS valve 20 to close. At times of engine running other than during such occurrences of the diagnostic procedure, LDP 24 does not operate, and computer 16 selectively operates CPS valve 20 such that CPS valve 20 opens under conditions conducive to purging and closes under conditions not conducive to purging. Thus, during times of operation of the automotive vehicle, the canister purge function is performed in the usual manner for the particular vehicle and engine so long as the diagnostic procedure is not being performed. When the diagnostic procedure is being performed, the evaporative emission space is closed so that it can be pressurized by LDP 24.

Figure 2:
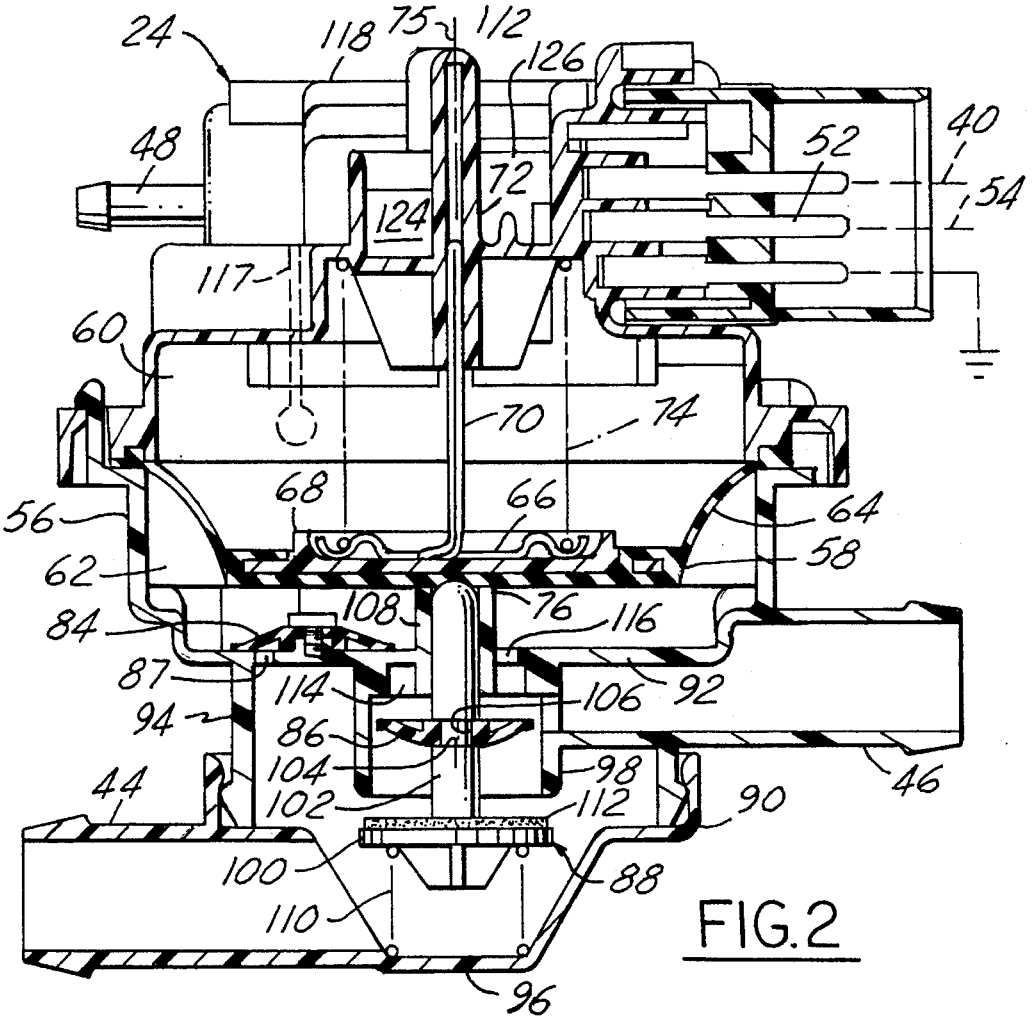
FIG. 2 is a longitudinal cross sectional view through one of the components of FIG. 1, by itself.

Attention is now directed to details of LDP 24 with reference to FIG. 2. LDP 24 comprises a housing 56 composed of several parts assembled together, these parts preferably being suitable fuel-resistant plastic. Interior of the housing, a movable wall 58 divides housing 56 into a vacuum chamber space 60 and an air pumping chamber space 62. Movable wall 58 comprises a general circular diaphragm 64 that is flexible, but essentially non-stretchable, and that has an outer peripheral margin captured in a sealed manner between two of the housing parts. The generally circular base 66 of an insert 68 is held in assembly against a central region of a face of diaphragm 64 that is toward chamber space 60. A cylindrical shaft 70 projects centrally from base 66 into a cylindrical sleeve 72 formed in one of the housing parts. A mechanical spring 74 in the form of a helical metal coil is disposed in chamber space 60 in outward circumferentially bounding relation to shaft 70, and its axial ends are seated in respective seats formed in base 66 and that portion of the housing bounding sleeve 72. Spring 74 acts to urge movable wall 58 axially toward chamber space 62 while the coaction of shaft 70 with sleeve 72 serves to constrain motion of the central region of the movable wall to straight line motion along an imaginary axis 75. The position illustrated by FIG. 2 shows spring 74 forcing a central portion of a face of diaphragm 58 that is toward chamber space 62 against a stop 76, and this represents the position which the mechanism assumes when the LDP is not being operated.

Ports 44 and 46 selectively communicate with each other and with chamber space 62 by valve arrangements that comprise two one-way umbrella valves 84, 86, and a plunger valve 88. Housing 56 comprises a walled enclosure 90 directly below, and separated from, chamber space 62 by a wall 92 that is perpendicular to axis 75. Enclosure 90 may be considered to comprise a generally circular sidewall 94 extending downward from wall 92 and a somewhat dome-shaped end wall 96 forming the enclosure's bottom. Port 44 intercepts the side of the dome of wall 96 so as to be open to the interior of enclosure 90. Port 46 passes through sidewall 94 and continues on until it intercepts a circular wall 98 that extends downward from wall 92 coaxial with axis 75 but that lies radially inwardly of sidewall 94 and also stops short of end wall 96. Port 46 is open to the space surrounded by wall 98 and has no communication with the interior of enclosure 90 along that portion of its length that lies between walls 94 and 98.

A portion of wall 92 that is disposed radially outwardly of wall 98 relative to axis 75 provides a mounting for valve 84 that allows air to pass from port 44, through the interior of enclosure 90 between walls 94 and 98, and into chamber space 62 through one or more through-holes 87 in wall 92, but not in the opposite direction. FIG. 2 shows the normally closed condition of the umbrella-type valve 84, whose center is retentively held on wall 92, and the outer peripheral margin of which seals against wall 92 in outwardly spaced relation to the one or more through-holes 87 in the wall, thus closing these through-holes to flow.

Plunger valve 88 is the vent valve for the evaporative emission system, and it serves two purposes: one, it comprises a head 100 for selectively unseating from and seating on the otherwise open lower end of wall 98 constituting a valve seat, so as to allow and disallow atmospheric venting of the evaporative emission space via the canister vent port; and two, it comprises a stem 102 that provides a mounting for one-way valve 86. The mounting comprises providing stem 102 with a circular groove 104 that seats, and axially and radially locates, valve 86 to be coaxial with the stem. Valve 86 has a central through-hole 106 allowing it to be fitted onto stem 102 and seated in groove 104 in the manner shown and described.

Stop 76 is provided as the upper axial end of a cylindrical sleeve 108 that is integrally formed with, and extends coaxial to axis 75 through, wall 92 between the space circumferentially bounded by wall 98 and chamber space 62. It provides axial guidance for travel of plunger valve 88 by affording a close sliding fit with the upper end of stem 102. A second helical coil spring 110 acting against head 100 imparts an upward axial bias force on plunger valve 88 causing the rounded upper end of stem 102 to bear against the center of movable wall 58 in the condition depicted by FIG. 2. The force exerted by spring 110 is however insufficient relative to the opposing force of spring 74 to dislodge the center portion of movable wall 58 from stop 76 in the FIG. 2 condition; rather the force of spring 110 is selected to assure that when the central region of movable wall 58 has been displaced upwardly greater than a certain distance from stop 76, spring 110 will force the contemporaneous closure of the open lower end of wall 98 by valve head 100 and the positioning of valve 86 on the central region of wall 92 that is circumferentially bounded by wall 98. The fragmentary view of FIG. 3 shows the condition where such upward displacement of wall 58 has occurred.

The shapes of both dome 96 and head 100 provide seatings for the respective ends of spring 110. Head 100 is essentially a circular flange that radially overlaps the opening at the lower end of wall 98. For closing that end in a sufficiently sealed manner, an annular seal 112 is on the face of head 100 for sealing to the circular rim of wall 98.

The central region of wall 92 that is bounded by wall 98 is nominally thickened, but it contains an annular groove 114 that is axially open toward valve 86 and one or more through-holes 116 that extend axially from the groove to chamber space 62. The outer circular margin of valve 86 radially overlaps the I.D. of wall 98 so that in the FIG. 3 position, the valve is closing chamber space 62 from the space surrounded by wall 98.

A solenoid valve 118 is disposed atop housing 56, as appears in FIG. 2. Valve 118 is like that disclosed in Ser. No. 07/995,484 and comprises a solenoid that is connected via connection 40 with computer 16. In addition to vacuum inlet port 48, valve 118 comprises an atmospheric port (not shown) for communication with ambient atmosphere and an outlet port that communicates with chamber space 60 by means of an internal passageway that is schematically represented at 117.

In the position depicted by FIG. 2, the atmospheric port of valve 118 is communicated to chamber space 60, resulting in the latter being at atmospheric pressure. When the solenoid of valve 118 is energized, the atmospheric port is closed and the vacuum inlet port 48 opened, thereby communicating vacuum inlet port 48 to chamber space 60.

The LDP has two further components, namely a permanent magnet 124 and a reed switch 126. The two are mounted on the exterior of the housing wall on opposite sides of where the closed end of sleeve 72 protrudes. Shaft 70 is a ferromagnetic material, and in the position of FIG. 2, it is disposed below the magnet and reed switch where it does not interfere with the action of the magnet on the reed switch. However, as shaft 70 moves upwardly within sleeve 72, a point will be reached where it shunts sufficient magnetic flux from magnet 124, that reed switch 126 no longer remains under the influence of the magnet, and hence the reed switch switches from one state to another. Let it be assumed that the reed switch switches from open to closed at such switch point, being open for positions of shaft 70 below the switch point and closed for positions of shaft 70 above the switch point. This switch point is however significantly below the uppermost limit of travel of the shaft, such limit being defined in this particular embodiment by abutment of the upper end of shaft 70 with the closed end wall of sleeve 72. For all upward travel of shaft 70 above the switch point, reed switch 126 remains closed. When shaft 70 once again travels downwardly, reed switch 126 will revert to open upon the shaft reaching the switch point. Reed switch 126 is connected with an output terminal 52 so that the reed switch's state can be monitored by computer 16 via connection 40.

Sufficient detail of FIG. 2 having thus been described, the operation of the invention may now be explained. First computer 16 commands CPS valve 20 to be closed. It then energizes valve 118 causing intake manifold vacuum to be delivered through valve 118 to vacuum chamber space 60. For the typical magnitudes of intake manifold vacuum that exist when the engine is running, the area of movable wall 58 is sufficiently large in comparison to the force exerted by spring 74 that movable wall 58 is displaced upwardly, thereby reducing the volume of vacuum chamber space 60 in the process while simultaneously increasing the volume of air pumping chamber space 62. The upward displacement of movable wall 58 is limited by any suitable means of abutment and in this particular embodiment it is, as already mentioned, by abutment of the end of shaft 70 with the closed end wall of sleeve 72.

The motion of wall 58 away from stop 76 allows spring 110 to concurrently push plunger valve 88 upward so that after an initial upward displacement of wall 58, head 100 of plunger valve 88 closes the open end of wall 98 and valve 86 is positioned on wall 92 to function as a one-way valve for allowing flow out of chamber space 62, but not into it.

The plunger valve's closure of the open lower end of wall 98 closes the atmospheric vent to the canister vent port. As the volume of air pumping chamber space 62 increases during the upward motion of movable wall 58, a certain pressure differential is created across one-way valve 84 resulting in the valve opening at a certain relatively small pressure differential to allow atmospheric air to pass through port 44 into chamber space 62. When a sufficient amount of ambient atmospheric air has been drawn into chamber space 62 to reduce the pressure differential across valve 84 to a level that is insufficient to maintain the valve open, the valve closes. At this time, air pumping chamber space 62 contains a charge of air that is substantially at ambient atmospheric pressure, i.e. atmospheric pressure less drop across valve 84.

Under typical operating conditions, the time required for the charge of atmospheric air to be created in air pumping chamber space 62 is well defined. This information is contained in computer 16 and is utilized by the computer to terminate the energization of valve 118 after a time that is sufficiently long enough, but not appreciably longer, to assure that for all anticipated operating conditions, chamber space 62 will be charged substantially to atmospheric pressure with movable wall 58 in its uppermost position of travel. The termination of the energization of solenoid valve 118 by computer 16 immediately causes vacuum chamber space 60 to be vented to atmosphere. The pressure in chamber space 60 now quickly returns to ambient atmospheric pressure, causing the net force acting on movable wall 58 to be essentially solely that of spring 74.

The spring force now displaces movable wall 58 downwardly compressing the air in chamber space 62. When the charge of air has been compressed sufficiently to create a certain pressure differential across one-way valve 86, the latter opens. Continued displacement of movable wall 58 by spring 74 forces some of the compressed air in chamber space 62 through port 46 and into the evaporative emission space via the canister vent port. Spring 110 is sufficiently strong to resist the force of the compressed air so that plunger valve 88 continues to prevent the atmospheric venting of the canister vent port.

When movable wall 58 has been displaced downwardly to a point where shaft 70 ceases to maintain reed switch 126 closed, the latter opens. The switch opening is immediately detected by computer 16 which immediately energizes solenoid 118 once again. The energizing of solenoid 118 now causes manifold vacuum to once again be applied to chamber space 60, reversing the motion of movable wall 58 from down to up. The downward motion of movable wall 58 between the position at which shaft 70 abuts the closed end wall of sleeve 72 and the position at which reed switch 126 switches from closed to open represents a compression stroke wherein a charge of air in chamber space 62 is compressed and a portion of the compressed charge is pumped into the evaporative emission space. Upward motion of movable wall 58 from a position at which reed switch 126 switches from open to closed to a position where the end of shaft 72 abuts the closed end of sleeve 70 represents an intake stroke. It is to be noted that switch 126 will open before movable wall 58 abuts the rounded end of the plunger valve stem, and in this way it is assured that the movable wall will not assume a position that one, prevents it from being intake-stroked when it is intended that the movable wall should continue to reciprocate after a compression stroke, and two, displaces the plunger valve from the FIG. 3 position.

At the beginning of a diagnostic procedure, the pressure in the evaporative emission space will be somewhere near atmospheric pressure, and therefore the time required for spring 74 to force a portion of the charge from chamber space 62 into the evaporative emission space will be relatively short. This means that movable wall 58 will execute a relatively rapid compression stroke once vacuum chamber 60 has been vented to atmosphere by valve 88. If a gross leak is present in the evaporative emission space, LDP 24 will be incapable of building pressure substantially to a predetermined level which is utilized in the procedure once the possibility of a gross leak has been eliminated. Hence, continued rapid reciprocation of movable wall 58 over a length of time that has been predetermined to be sufficient to provide for the pressure to build in the evaporative emission space substantially to the level at which a later part of the procedure is otherwise conducted, will indicate the existence of a gross leak, and the procedure may be terminated at this juncture. Thus, the frequency at which switch 126 operates is used in the first instance to determine whether or not a gross leak is present, such gross leak being indicated by continuing rapid actuation of the switch over such a predetermined length of time.

If no gross leak is present, the evaporative emission space pressure will build substantially to a predetermined magnitude, or target level, which is essentially a function of solely spring 74. In the theoretical case of an evaporative emission space which has zero leakage, a point will be reached where spring 74 is incapable of providing sufficient force to force any more compressed air into the evaporative emission space. Accordingly, switch 126 will cease switching when that occurs.

If, once the target pressure has been substantially reached, there is some leakage less than a gross leak, pump 24 will function to maintain pressure in the evaporative emission space by replenishing the losses due to the leakage. A rate at which the pump reciprocates is related to the size of the leak such that the larger the leak, the faster the pump reciprocates and the smaller the leak, the slower it reciprocates. The rate of reciprocation is detected by computer 16 by monitoring the rate at which switch 126 switches. The rate of switch actuation can provide a fairly accurate measurement of the effective orifice size of the leakage. Leakage that is greater than a predefined effective orifice size may be deemed unacceptable while a smaller leakage may be deemed acceptable. In this way, the integrity of the evaporative emission space may be either confirmed or denied, even for relatively small effective orifice sizes. At the end of the procedure, computer 16 shuts off LDP 24 and allows CPS valve 20 to re-open on subsequent command.

A lack of integrity may be due to any one or more of a number of reasons. For example, there may be leakage from fuel tank 14, canister 18, or any of the conduits 26, 30, and 34. Likewise, failure of CPS valve 20 to fully close during the procedure will also be a source of leakage and can be detected. Even though the mass of air that is pumped into the evaporative emission space will to some extent be an inverse function of the pressure in that space, the LDP may be deemed a positive displacement pump because of the fact that it reciprocates over a fairly well defined stroke.

Figure 4:
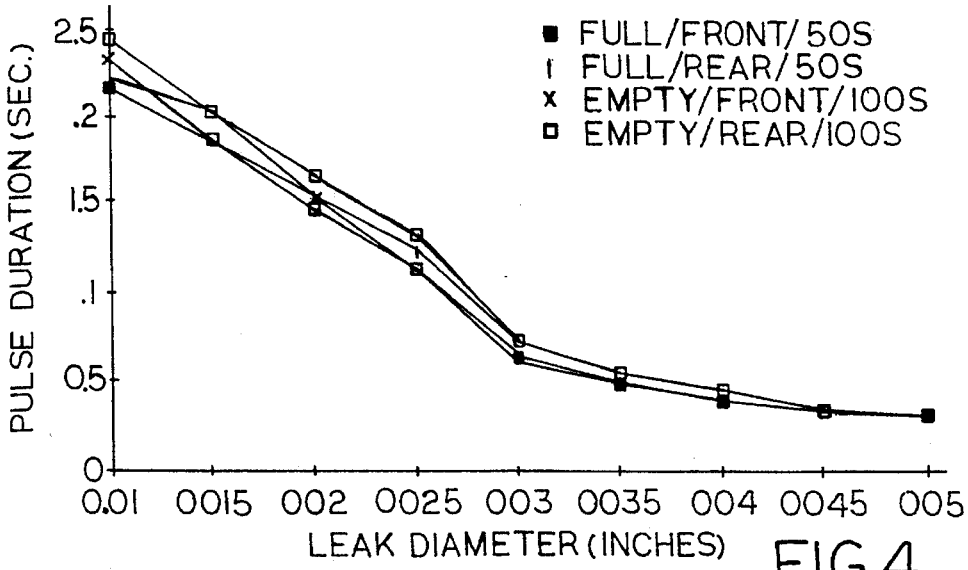
FIG. 4 is a graph plot useful in appreciating certain principles of the present invention.

FIG. 4 is a typical graph plot illustrating how the present invention can provide a measurement of leakage. The horizontal axis represents a range of effective leak diameters, and the vertical axis, a range of pulse durations. In the case of the pumps that have been described, pulse duration would be defined as the time between consecutive actuations of reed switch 126 from closed to open, but it can be defined in other ways that are substantially equivalent to this way or that provide substantially the same information. The graph plot contains four graphs each of which represents pulse duration as a function of leak diameter for a particular combination of three test conditions, such three conditions being fuel level in the tank, location of an intentionally created leak orifice, and the duration of the test. As one can see, the four graphs closely match each other, proving that a definite relationship exists for the invention to provide a reasonably accurate measurement of leakage, even down to sizes that have quite a small effective orifice diameter. This measurement capability enables the engine management computer, or any other on-board data recorder, to log results of individual tests and thereby create a test history that may be useful for various purposes. The memory of the computer may be used as an indicating means to log the test results. The automobile may also contain an indicating means that draws the attention of the driver to the test results, such an indicating means being an instrument panel display. If a diagnostic procedure indicates that the evaporative emission system has integrity, it may be deemed unnecessary for the result to be automatically displayed to the driver; in other words, automatic display of a test result may be given to the driver only in the event of an indication of non-integrity. A test result may be given in the form of an actual measurement and/or a simple indication of integrity or non-integrity.

Because of the ability of the LDP to provide measurement of the effective orifice size of leakage, it may be employed to measure the performance of CPS valve 20 and flow through the system at the end of the diagnostic procedure that has already been described herein. One way to accomplish this is for computer 16 to deliver a signal commanding a certain opening of CPS valve 20, thus creating what amounts to an intentionally introduced leak. If the CPS valve responds faithfully, the LDP will reciprocate at a rate corresponding substantially to the amount of CPS valve opening that has been commanded. If there is a discrepancy, it will be detected by the computer, and an appropriate indication may be given. If no discrepancy is detected, that is an indication that the CPS valve and the system are functioning properly.

While a presently preferred embodiment of the invention has been illustrated and described, it should be appreciated that principles are applicable to other embodiments that fall within the scope of the following claims. An example of such an embodiment could comprise an electric actuator to stroke the movable wall. Of course, any particular embodiment of the invention for a particular usage is designed in accordance with established engineering calculations and techniques, using materials suitable for the purpose.

What is claimed is:

1. An automotive vehicle comprising an internal combustion engine and a fuel system for said engine which comprises a fuel tank for storing volatile liquid fuel for the engine and an evaporative emission control system which comprises a collection canister that in cooperative combination with head space of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, valve means comprising a vent valve via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, said pump means comprising a positive displacement reciprocating pump having a walled housing comprising an air pumping chamber space having a movable wall, a non-movable wall that separates said air pumping chamber space from a walled enclosure containing said vent valve, said housing further comprising a first port communicating the interior of said enclosure to said evaporative emission space and a second port communicating the interior of said enclosure to atmosphere, said pump further comprising a mechanical spring that acts on said movable wall in a sense urging said movable wall toward contracting the volume of said air pumping chamber space, said pump further comprising a first one-way valve means arranged to allow air to pass through said second port from atmosphere and enter, but not exit, said air pumping chamber space, a second one-way valve means arranged to allow air to exit, but not enter, said air pumping chamber space and pass through said first port to said evaporative emission space, means effective while said valve means is closed to prevent communication of said evaporative emission space to atmosphere and while said canister purge valve is closed to prevent communication of said evaporative emission space to said intake manifold for repeatedly causing said movable wall to execute an intake stroke that expands the volume of said air pumping chamber space against force exerted thereon by said mechanical spring, causing the opening of said first one-way valve means in the process so that air fills said air pumping chamber space to create a measured charge volume of air at given pressure, and that imparts energy to said spring for the subsequent execution of a compression stroke that contracts the volume of said air pumping chamber space by extracting energy from said spring to compress said measured charge volume of air to pressure greater than such given pressure, causing the opening of said second one-way valve means in the process so that a portion of the air in said air pumping chamber space is forced into said evaporative emission space during a compression stroke, said first and second ports having respective points of communication with the interior of said enclosure, characterized in that, (1) both when said vent valve is open and when said vent valve is closed, one of said first and second one-way valve means is disposed in operative association with a first set of one or more through-holes in said non-movable wall through which said one of said first and second one-way valve means controls the passage of air between said air pumping chamber space and one of said first and second ports, (2) in that when said vent valve is closed, the other of said first and second one-way valve means is disposed in operative association with a second set of one or more through-holes in said non-movable wall through which said other of said first and second one-way valve means controls the passage of air between said air pumping chamber space and the other of said first and second ports, and (3) in that when said vent valve is open, said other of said first and second one-way valve means is disposed out of operative association with said second set of one or more through-holes so that air is capable of passing both into and out of said air pumping chamber space through said second set of one or more through-holes.

2. An automotive vehicle as set forth in claim 1 characterized further in that said housing comprises a vacuum chamber space that is divided by said movable wall from said air pumping chamber space and in that said pump comprises means for repeatedly causing said vacuum chamber space to be alternately communicated to intake manifold vacuum and to atmosphere such that during communication of said vacuum chamber space to intake manifold vacuum, said movable wall executes an intake stroke, and during communication of said vacuum chamber space to atmosphere, said mechanical spring forces said movable wall to execute a compression stroke.

3. An automotive vehicle as set forth in claim 2 characterized further in that said spring is disposed in said vacuum chamber space, and in that said housing comprises a limit stop disposed within said vacuum chamber space to define a limit for the end of an intake stroke of said movable wall.

4. An automotive vehicle as set forth in claim 3 characterized further by guide means guiding a central region of said movable wall for straight line motion as it executes intake and compression strokes, and by sensor means disposed proximate said guide means for sensing position of said central region of said movable wall along the direction of such straight line motion,

5. An automotive vehicle as set forth in claim 1 characterized further in that said one of said first and second one-way valve means is said first one-way valve means and said other of said first and second one-way valve means is said second one-way valve means.

6. An automotive vehicle as set forth in claim 5 characterized further in that said second one-way valve means mounts on a portion of said vent valve.

7. An automotive vehicle as set forth in claim 6 characterized further in that said vent valve comprises a head and a stem extending from said head, said walled enclosure comprising a seat on which said vent valve head seats when said vent valve is closed and from which said vent valve head is unseated when said vent valve is open, and in that said second one-way valve means mounts on said vent valve stem.

8. An automotive vehicle as set forth in claim 7 characterized further in that said second one-way valve means comprises an umbrella valve element that coaxially mounts on said vent valve stem.

9. An automotive vehicle as set forth in claim 8 characterized further in that resilient bias means resiliently biases said vent valve in a direction toward seating on said seat, and in that said vent valve stem is disposed to be acted upon by said movable wall and said mechanical spring when the pump is not being operated such that said vent valve is forced open by the force of said mechanical spring acting on said vent valve being greater than the force of said resilient bias means biasing said vent valve.

10. For use in an automotive vehicle comprising an internal combustion engine and a fuel system for the engine which comprises a fuel tank for storing volatile liquid fuel for the engine and an evaporative emission control system which comprises a collection canister that in cooperative combination with head space of the tank cooperatively defines an evaporative emission space wherein fuel vapors generated from the volatilization of fuel in the tank are temporarily confined and collected until periodically purged by means of a canister purge valve to an intake manifold of the engine for entrainment with induction flow of combustible mixture into combustion chamber space of the engine and ensuing combustion in the combustion chamber space, valve means comprising a vent valve via which the evaporative emission space is selectively communicated to atmosphere, the vehicle further comprising means for distinguishing between integrity and non-integrity of the evaporative emission control system, under conditions conducive to obtaining a reliable distinction between such integrity and non-integrity, against leakage of volatile fuel vapor from that portion thereof which includes the tank, the canister, the valve means, and the canister purge valve:

a positive displacement reciprocating pump having a walled housing comprising an air pumping chamber space having a movable wall, a non-movable wall that separates said air pumping chamber space from a walled enclosure containing said vent valve, said housing further comprising a first port adapted for communicating the interior of said enclosure to the evaporative emission space and a second port adapted for communicating the interior of said enclosure to atmosphere, said pump further comprising a mechanical spring that acts on said movable wall in a sense urging said movable wall toward contracting the volume of said air pumping chamber space, said pump further comprising a first one-way valve means arranged to allow air to pass through said second port from atmosphere and enter, but not exit, said air pumping chamber space, a second one-way valve means arranged to allow air to exit, but not enter, said air pumping chamber space and pass through said first port to the evaporative emission space, means effective while the valve means is closed to prevent communication of the evaporative emission space to atmosphere and while the canister purge valve is closed to prevent communication of the evaporative emission space to the intake manifold for repeatedly causing said movable wall to execute an intake stroke that expands the volume of said air pumping chamber space against force exerted thereon by said mechanical spring, causing the opening of said first one-way valve means in the process so that air fills said air pumping chamber space to create a measured charge volume of air at given pressure, and that imparts energy to said spring for the subsequent execution of a compression stroke that contracts the volume of said air pumping chamber space by extracting energy from said spring to compress said measured charge volume of air to pressure greater than such given pressure, causing the opening of said second one-way valve means in the process so that a portion of the air in said air pumping chamber space is forced into the evaporative emission space during a compression stroke, said first and second ports having respective points of communication with the interior of said enclosure, characterized in that, (1) both when said vent valve is open and when said vent valve is closed, one of said first and second one-way valve means is disposed in operative association with a first set of one or more through-holes in said non-movable wall through which said one of said first and second one-way valve means controls the passage of air between said air pumping chamber space and one of said first and second ports, (2) in that when said vent valve is closed, the other of said first and second one-way valve means is disposed in operative association with a second set of one or more through-holes in said non-movable wall through which said other of said first and second one-way valve means controls the passage of air between said air pumping chamber space and the other of said first and second ports, and (3) in that when said vent valve is open, said other of said first and second one-way valve means is disposed out of operative association with said second set of one or more through-holes so that air is capable of passing both into and out of said air pumping chamber space through said second set of one or more through-holes.

11. A pump as set forth in claim 10 characterized further in that said housing comprises a vacuum chamber space that is divided by said movable wall from said air pumping chamber space and in that said pump comprises means for repeatedly causing said vacuum chamber space to be alternately communicated to intake manifold vacuum and to atmosphere such that during communication of said vacuum chamber space to intake manifold vacuum, said movable wall executes an intake stroke, and during communication of said vacuum chamber space to atmosphere, said mechanical spring forces said movable wall to execute a compression stroke.

12. A pump as set forth in claim 11 characterized further in that said spring is disposed in said vacuum chamber space, and in that said housing comprises a limit stop disposed within said vacuum chamber space to define a limit for the end of an intake stroke of said movable wall.

13. A pump as set forth in claim 12 characterized further by guide means guiding a central region of said movable wall for straight line motion as it executes intake and compression strokes, and by sensor means disposed proximate said guide means for sensing position of said central region of said movable wall along the direction of such straight line motion.

14. A pump as set forth in claim 10 characterized further in that said one of said first and second one-way valve means is said first one-way valve means and said other of said first and second one-way valve means is said second one-way valve means.

15. A pump as set forth in claim 14 characterized further in that said second one-way valve means mounts on a portion of said vent valve.

16. A pump as set forth in claim 15 characterized further in that said vent valve comprises a head and a stem extending from said head, said walled enclosure comprising a seat on which said vent valve head seats when said vent valve is closed and from which said vent valve head is unseated when said vent valve is open, and in that said second one-way valve means mounts on said vent valve stem.

17. A pump as set forth in claim 16 characterized further in that said second one-way valve means comprises an umbrella valve element that coaxially mounts on said vent valve stem.

18. A pump as set forth in claim 17 characterized further in that resilient bias means resiliently biases said vent valve in a direction toward seating on said seat, and in that said vent valve stem is disposed to be acted upon by said movable wall and said mechanical spring when the pump is not being operated such that said vent valve is forced open by the force of said mechanical spring acting on said vent valve being greater than the force of said resilient bias means biasing said vent valve.

* * * * *